US007306025B2

(12) United States Patent
Steen

(10) Patent No.: US 7,306,025 B2
(45) Date of Patent: Dec. 11, 2007

(54) METHODS FOR CONTINUOUS CASTING OF A MOLTEN MATERIAL

(75) Inventor: Paul H. Steen, Ithaca, NY (US)

(73) Assignee: Cornell Research Foundation, Inc., Ithaca, NY (US)

( * ) Notice: Subject to any disclaimer, the term of this patent is extended or adjusted under 35 U.S.C. 154(b) by 0 days.

(21) Appl. No.: 11/395,673

(22) Filed: Mar. 31, 2006

(65) Prior Publication Data

US 2006/0243419 A1 Nov. 2, 2006

Related U.S. Application Data

(62) Division of application No. 10/072,404, filed on Feb. 8, 2002, now Pat. No. 7,082,986.

(51) Int. Cl.
*B22D 11/06* (2006.01)

(52) U.S. Cl. ..... 164/463

(58) Field of Classification Search ..... 164/463, 164/479, 338.1, 423
See application file for complete search history.

(56) References Cited

U.S. PATENT DOCUMENTS

| | | | |
|---|---|---|---|
| 49,053 | A | 7/1865 | Bessemer |
| 4,142,571 | A | 3/1979 | Narasimhan |
| 4,268,564 | A | 5/1981 | Narasimhan |
| 4,588,015 | A | 5/1986 | Liebermann |
| 4,600,048 | A | 7/1986 | Sato et al. |
| 4,676,298 | A | 6/1987 | Liebermann |
| 4,705,095 | A | 11/1987 | Gaspar |
| 4,708,194 | A | 11/1987 | Mohn |
| 4,887,662 | A | 12/1989 | Tanaka et al. |
| 6,099,913 | A | 8/2000 | Clarke et al. |
| 7,082,986 | B2 * | 8/2006 | Steen ..... 164/463 |

OTHER PUBLICATIONS

Kavesh, "Principles of Fabrication," Gilman, eds., *Metallic Glasses*, ASM, Metals Park, pp. 36-73 (1978).
Jones, "Rapid Solidification of Metals and Alloys," Gilman et al. (eds.), *Metallic Glasses*, Institution of Metallurgists, London, pp. 1-83 (1982).
Jones, "Review: The Status of Rapid Solidification of Alloys in Research and Application," *Journal of Materials Science*, 19:1043-1076 (1984).
Beldon, "Commercializing A New Product," *ChE Progress*, pp. 27-29 (1985).
Birat et al., "Near Net Shape Continuous Casting Of Flat Products At IRSID," *La Revue de Métallurgie—CIT* 86:919-930 (1989).
Anestiev, "An Analysis of the Dependence Between the Ribbon Dimensions and the Technological Parameters for the Planar Flow Casting Method," *Materials of Science and Engineering*. A131:115-121 (1991).
Carpenter et al., "Fluid Mechanics An Heat Transfer Of Planar-Flow Melt Spinning," *Modeling Of Casting, Welding and Advanced Solidification Processes V*, Rappaz et al. (eds.), Warrendale, PA:TMS, pp. 621-627 (1991).

(Continued)

*Primary Examiner*—Kevin P. Kerns
(74) *Attorney, Agent, or Firm*—Nixon Peabody LLP

(57) ABSTRACT

A method for controlling and manipulating solidification of a molten material includes generating a gradient pattern on at least a portion of a substrate and depositing the molten material on at least a portion of the substrate with the gradient pattern.

24 Claims, 6 Drawing Sheets

OTHER PUBLICATIONS

Gong et al., "Numerical Modelling Of The Planar Flow Melt-Spinning Process And Experimental Investigation Of Its Solidification Puddle Dynamics," *International Journal of Rapid Solidification*. 6:1-28 (1991).
Wang et al., "Modelling Of Rapid Solidification By Melt Spinning: Effect Of Heat Transfer In The Cooling Substrate," *Materials Science and Engineering*, A136:85-97 (1991).
Birat, "Direct Casting of Thin Strip Steel," *Endeavour, New Series*, 16:110-116 (1992).
Carpenter et al., "Plannar-Flow Spin-Casting Of Molten Metals: Process Behavior," *Journal of Materials Science*, 27:215-225 (1992).
Praisner, et al., "An Experimental Study of Process Behavior in Planar Flow Melt Spinning," *Metallurgical and Materials Transactions B*, 26B:1199-1208 (1995).
G. Li and B. G. Thomas, "Transient Thermal Model Of The Continuous Single-Wheel Thin-Strip Casting Process," Proc. Int. Symp on Near-Net-Shape Casting in the Minimills, Vancourver, Canada Aug 19-23, 1995, Canadian Institute of Mining, Metallurgy, and Petroleum, Montreal, Canada, pp. 373-387 (1995).
Ibaraki, "Planar Flow Melt-Spinning: Experimental Investigation On Solidification, Dynamics Of The Liquid Puddle And Process Operability," Master's Thesis, Cornell University (1996).
Li et al., "Transient Thermal Model of the Continuous Single-Wheel Casting of Thin Steel Strip," *Metallurgical and Materials Transactions B*, 27B:509-525 (1996).
Carpenter et al., Heat Transfer And Solidification In Planar-Flow Melt-Spinning: High Wheelspeeds, *International Journal of Heat Mass Transfer*, 40(9):1993-2007 (1997).
Steen et al., "Fluid Mechanics Of Spin Casting," *Ann. Rev. Fluid Mechanics*, 29:373-397 (1997).
Chen et al., "Modeling And Optimization Of Nozzle Design In Planar Flow Melt Spinning," *MED Manufacturing Science And Engineering* (ASME), 10:79-85 (1999).
Steen et al., "Contacting And Forming Singularities: Distinguishing Examples," *Chaos*, 9(1):164-172 (1999).
Walranch et al., "The Early Stages In Aluminum Solidification In the Presence Of A Moving Meniscus," Zabaras eds., *The Integration Of Material, Process And Product Design*, Balkema, Rotterdam, pp. 183-191 (1999).
Kuhn, "Unsteady Behavior Of The Planar Flow Spin-Casting Process," Master's Thesis, Cornell University p. 47 (2000).
Plaschko et al., "Stability Of Two-Dimensional Strip Casting Processes," *Physics of Fluids*, 12(6): 1319-1326 (2000).
Karcher et al., "High-Reynolds-Number Flow In a Narrow Gap Driven By Solidification, I. Theory," *Physics of Fluids*, 13(4): 826-833 (2001).
Karcher et al., "High-Reynolds-Number Flow In A Narrow Gap Driven By Solidification, II. Planar-Flow Casting Application," *Physics of Fluids*, 13(4): 834-840 (2001).
Reed, "Planar-Flow Spin Casting: Momentum Transport, Verticity Transport, And Texture Formation," PhD Thesis, Cornell University pp. 104-106 (2001).
Reed et al., "Vorticity Transport In Solidification Boundary Layers," *J. Fluid Mech.*, 426:397-406 (2001).
Steen et al., "Solidification-Induced Secondary Flows In Spin Casting," Ehrhard eds., *Interactive Dynamics Of Convection And Solidification*, Kluwer Academic Publishers, Netherlands, pp. 145-153 (2001).
"Aluminum Technology Roadmap Workshop," U.S. Department of Energy, Office Of Industrial Technologies, Energetics (1997.).

* cited by examiner

METHODS FOR CONTINUOUS CASTING OF A MOLTEN MATERIAL

This application is a divisional of prior application Ser. No. 10/072,404, filed Feb. 8, 2002 now U.S. Pat. No. 7,082,986.

This invention was made with Government support from the National Science Foundation (NSF) under Grant No. DMI-9712520. The Government has certain rights in the invention.

FIELD OF THE INVENTION

The present invention relates generally to a system and method for controlling the solidification of a molten material and, more particularly, to a system and method for continuous casting of a molten material into a flat product in a single step. Flat product is variously referred to as thin flat product, sheet, strip, ribbon or foil depending on thickness and width, and on the industrial application.

BACKGROUND

Continuous spin-casting is a process where molten metal is forced through a nozzle onto a substrate where it freezes and is spun off as ribbon product. The contacting interface between the substrate and the molten metal affects the surfaces (top or bottom sides) of the resulting ribbon product. With respect to thicker ribbon product, i.e. ribbon product having a thickness greater than about 50 mm, the effects on the surface only impact a small fraction of the thickness of the ribbon product and thus generally are negligible. However, as the ribbon product becomes thinner, i.e. has a ribbon product thickness less than about 1 mm, the effects on the surface of the ribbon product impact a larger percentage of the thickness of the ribbon product. As a result, substantially single step continuous casting has only been used to a limited extent commercially to produce flat product. One example of such a continuous spin-casting process that has been used commercially is disclosed in U.S. Pat. No. 4,142,571 to Narasimhan which is herein incorporated by reference.

Instead one prior technique to produce a thin ribbon product, such as aluminum sheet, is to first cast, on the order of about 500 mm thick, a thick slab using the twin-roll process or otherwise and then to subject the slab to a sequence of hot and cold rolling stages until the thickness of the slab is reduced on the order of $10^4$:1. Although this process works, it requires a number of steps, a large capital investment, generates considerable scrap and consumes a relatively large amount of energy.

Mechanical conditioning of the substrate to manipulate cast quality and to obtain thicker ribbon product has been suggested in, "The early stages in aluminum solidification in the presence of a moving meniscus" by D. Weirauch in, "The integration of Material, Process and Product Design", pages 183-191 and by U.S. Pat. No. 4,705,095 to Gasper which are both herein incorporated by reference.

SUMMARY

A method for controlling and manipulating solidification of a molten material in accordance with another embodiment of the present invention includes generating a gradient pattern on at least a portion of the substrate and depositing the molten material on at least a portion of the substrate with the gradient pattern.

A method for continuous casting of a molten material in accordance with yet another embodiment of the present invention includes rotating a substrate, generating a gradient pattern on at least a portion of the substrate, and depositing the molten material on at least a portion of the substrate with the gradient pattern.

The present invention provides a process for high speed (throughput) casting of flat product of high quality. Gradient patterns are created by a substantially uniform source at microscale, laser hot spots or droplets that dry to make dots of thin solid film on the substrate. This uniform source is then "printed" in a pattern to make a desired gradient on the macroscale. The effect is a continuum or gradient on the macroscale because of the difference in length scale between dots and patterns and because of the number of spots.

The present invention provides a system and method for continuous casting of molten metals to the specifications of the designer and also for coating a product with a molten material. Reducing the number of processing steps by using the present invention will also greatly reduce the cost of the manufacturing equipment needed and, in some cases, will also yield significant increases in productivity when compared against prior manufacturing techniques. Further, the present invention is 'tunable' to permit a manufacturer to manipulate the form of the final product providing manufacturers with greater flexibility in meeting specific demands. By simplifying the manufacturing process and reducing the amount of scrap, the present invention will also save energy when compared against prior manufacturing techniques and thereby will substantially reduce $CO_2$ emissions to the atmosphere.

DETAILED DESCRIPTION

Figure 1:
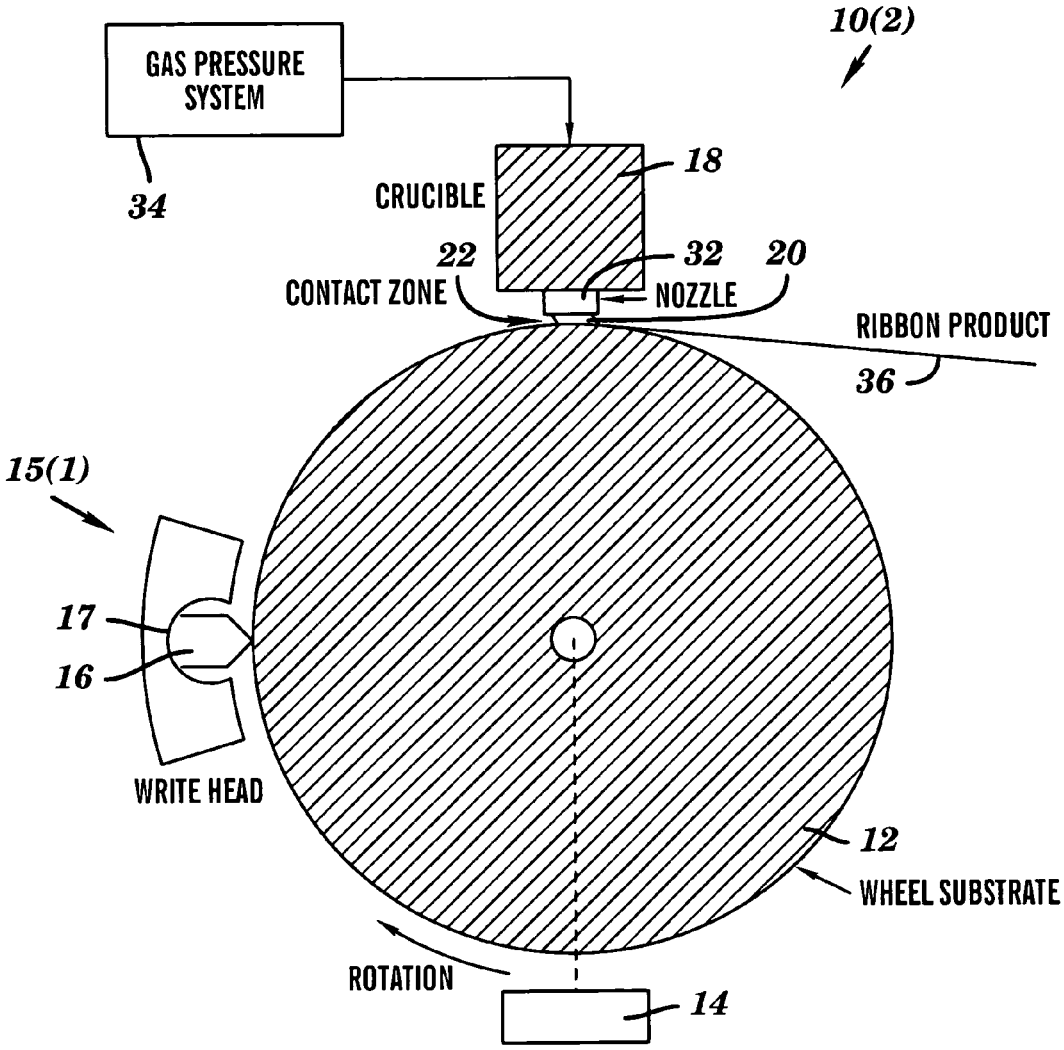
FIG. 1 is a side view of a system for casting a molten material in accordance with one embodiment of the present invention.

A system 10(1) for casting a molten material in accordance with one embodiment of the present invention is illustrated in FIG. 1. The system 10(1) includes a substrate 12 on which a molten material is deposited, a driving system 14 that rotates the substrate 12, a thermal writing system 15(1), and a source 18 for the molten material 20. A method in accordance with one embodiment includes rotating the substrate 12, generating a thermal gradient pattern on at least a portion of the substrate 12, and depositing the molten material on at least a portion of the substrate 12 with the thermal gradient pattern. The present invention provides a number of advantages including providing a system and method for continuous casting of a molten material 20, in a single step, to the specifications of the designer and also a system and method for coating a product with the molten material 20.

Referring to FIG. 1, the substrate 12 comprises a single wheel, although other types of substrates can be used, such as a belt or a product that is to be coated with the molten material 20. In this particular embodiment, the substrate 12 has a circumference of about three meters and a width of about 12.5 cm, although the particular dimensions of the substrate 12 can vary as needed for the particular application. Although not shown, the substrate 12 may also include a cooling system to actively cool the substrate 12 during the casting process.

The driving system 14 is coupled to the substrate 12 to rotate the substrate 12. A variety of different mechanical systems, such as a shaft or rollers on which the substrate 12 is seated and which are rotated by motor, can be used to rotate the substrate 12.

The writing system 15(1) is a thermal writing system comprising a laser 16 and a laser control system 17, although other types of writing systems with other components, such as multiple lasers, can be used. An output end of the laser 16 is adjacent to and spaced from a portion of the substrate 12 before the contact region or zone 22. The laser 16 generates a laser light signal that induces hot spots on a portion of the substrate 12 directly by heating or bare spots indirectly by removing a previously deposited thin solid film on the surface of the substrate 12. The laser control system 17 includes a processor coupled to a memory which stores programmed instructions to be executed by the processor to set the characteristics of the generated laser light signal or beam and the position and movement of the laser light signal with respect to the substrate 12 to generate a desired thermal gradient pattern, although laser control system 17 can comprise other components and can operate in other manners. Adjusting the configuration and/or characteristics of the pattern affects the resulting product 36 being produced. In this particular embodiment, the laser control system 17 manipulates the laser light signal from the laser 16 to traverse slowly in a crosswise direction across the width of the substrate 12, although the laser 16 can be manipulated to move in other directions. The frequency of the laser can also be manipulated while the laser waves.

Figure 4A:
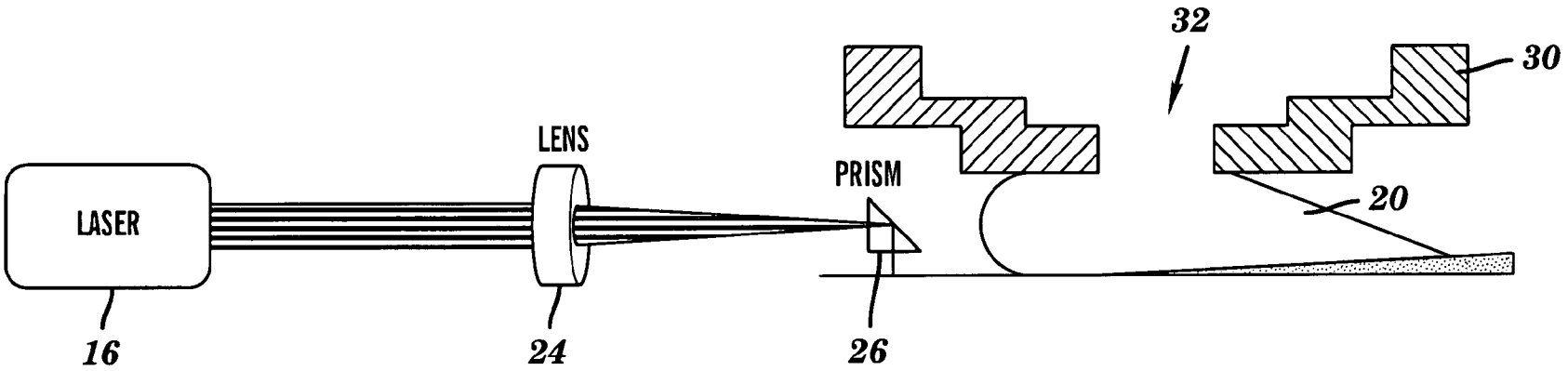
FIG. 4A is a side view of an alternative embodiment of a writing system for the system in accordance with the present invention.
Figure 4B:
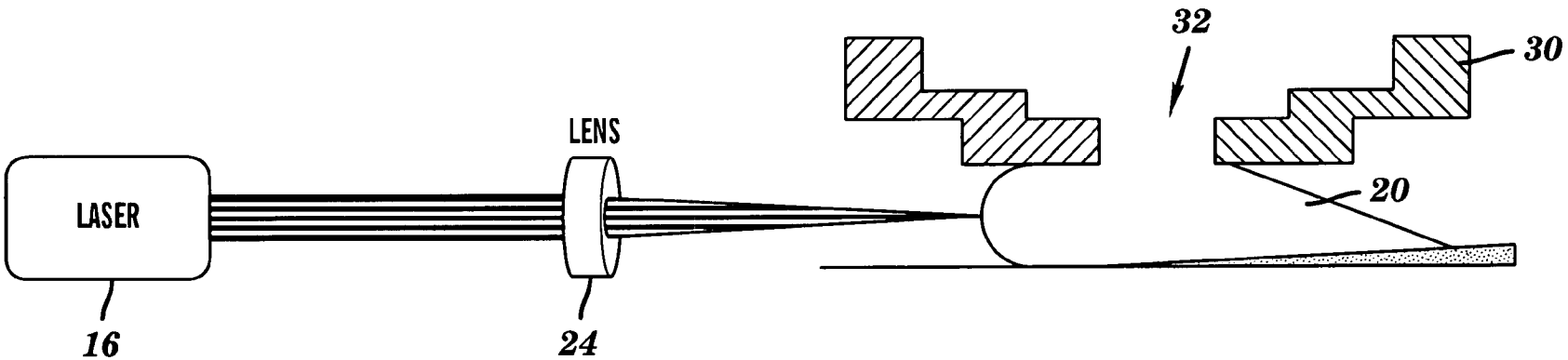
FIG. 4B is a side view of yet another alternative embodiment of a writing system for the system in accordance with the present invention.
Figure 5A:
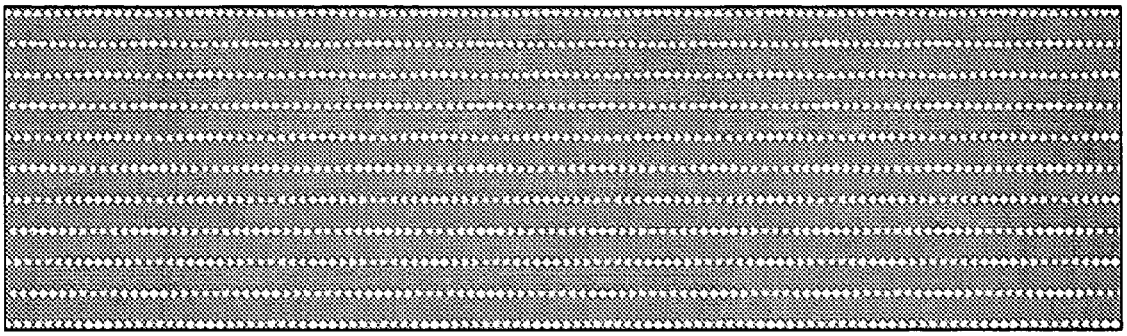
FIG. 5A is a diagram of a thermal gradient pattern on the substrate at a laser frequency of about two kilohertz without a prism and cross-stream translation of about one cm/s.
Figure 5B:
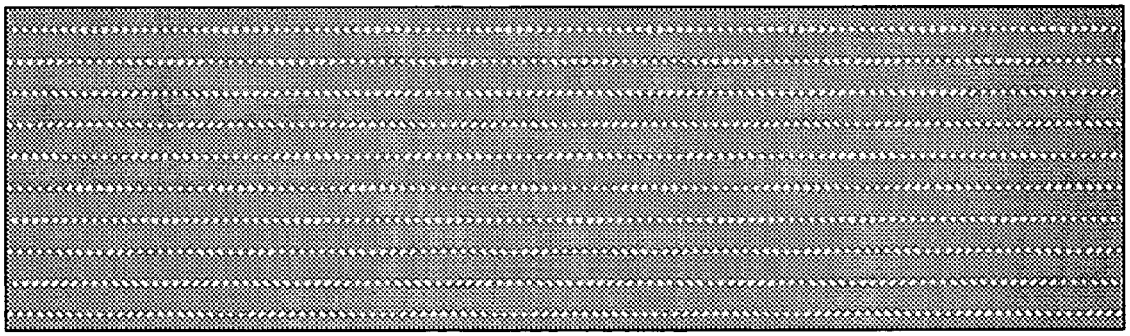
FIG. 5B is a diagram of a thermal gradient pattern on the substrate at a laser frequency of about two kilohertz with a prism.
Figure 5C:
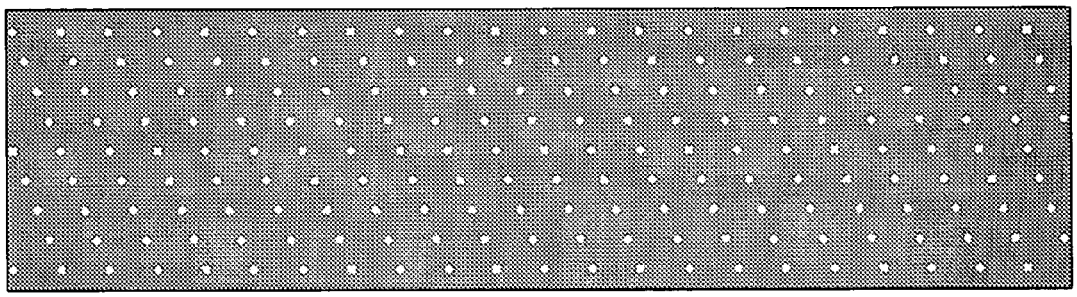
FIG. 5C is a diagram of a thermal gradient pattern on the substrate at a laser frequency of about ten kilohertz without a prism.
Figure 5D:
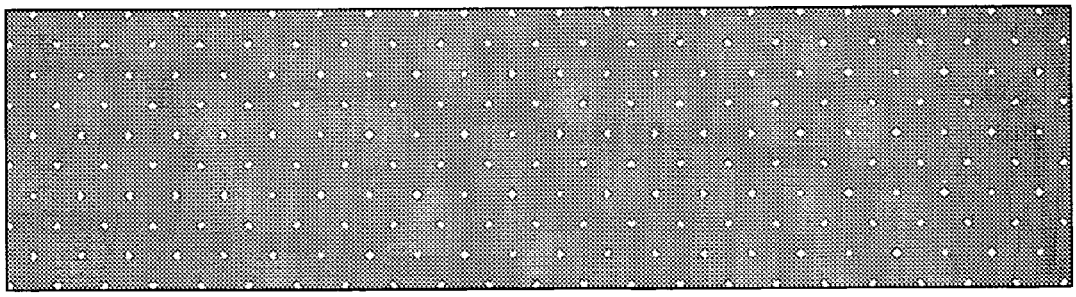
FIG. 5D is a diagram of a thermal gradient pattern on the substrate at a laser frequency of about ten kilohertz with a prism.

As shown in an alternative embodiment in FIG. 4A, the thermal writing system may also include a focusing lens 24 and a prism 26. In this embodiment, the focusing lens 24 and the prism 26 reflect the laser light signal generated by the laser 16 on to a portion of the substrate 12, although the prism 26 can be configured to reflect the light in other directions. As shown in yet another alternative embodiment shown in FIG. 4B, the thermal writing system may just include the focusing lens 24. In this embodiment, the focusing lens 24 directs the laser light signal generated by the laser 16 on to a portion of the molten material 20 to condition the molten material before depositing it on the substrate 12, although the lens can be positioned to reflect the light in other directions.

Figure 3:
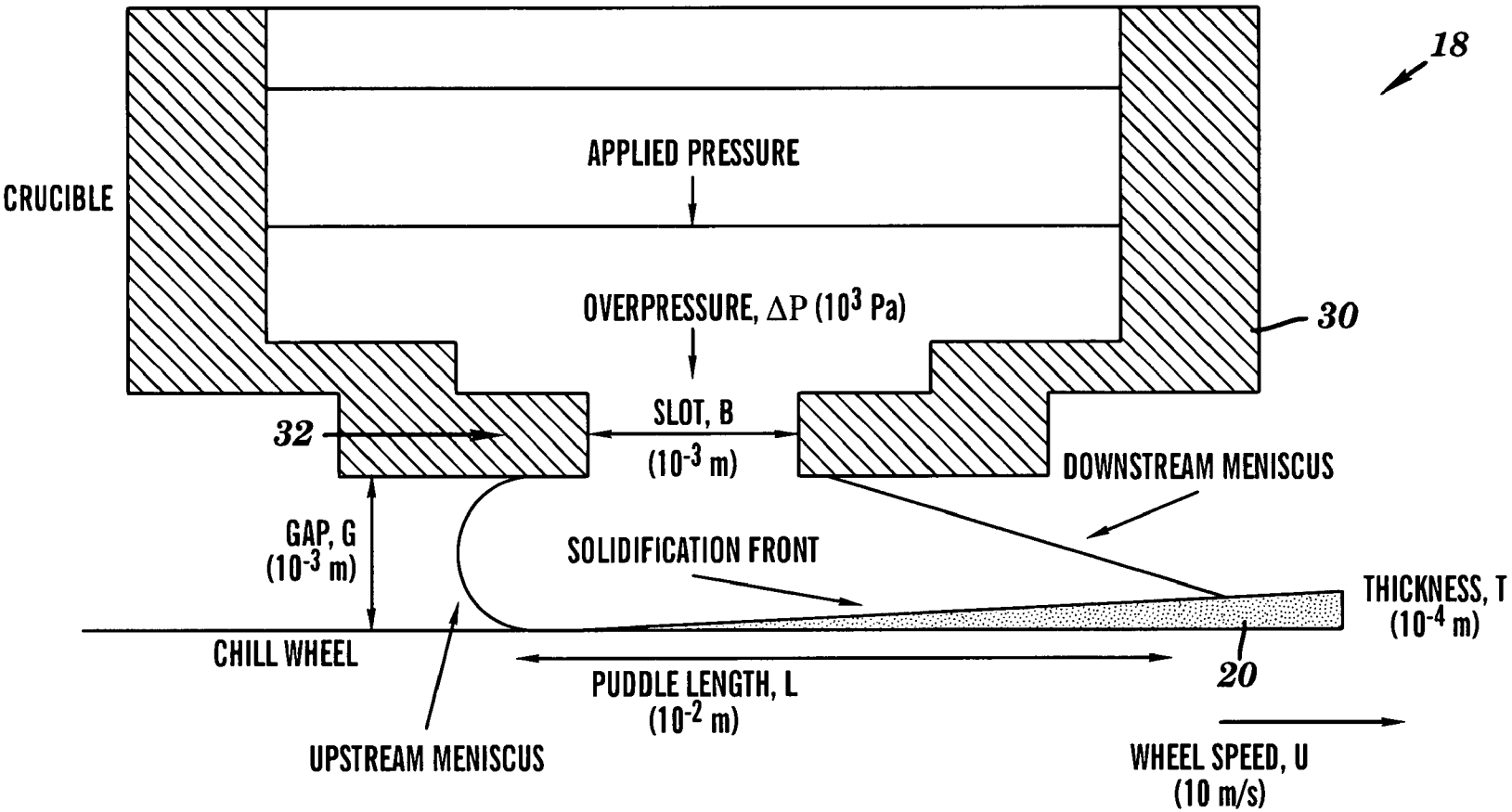
FIG. 3 is an enlarged, cross-sectional view of a contact zone region (which is not to scale) in the system shown in FIG. 1. The dimensions given on FIG. 3 are approximate.

Referring to FIGS. 1 and 3, the source 18 for the molten material includes a container or crucible 30 for holding the molten material, a nozzle 32, and a pressure system 34, although the source 18 for molten material can be comprised of other types of and combinations of elements. The nozzle 32 of the source 18 is formed in the container 30 and is positioned adjacent to and spaced from the substrate 12, although other types of nozzles which are part of or are connected to the container 30 can be used. In this particular embodiment, the pressure system 34 comprises a tank of pressurized inert gas, such as Argon, which is supplied to the container 30 via a tube or other conduit. The supplied gas applies pressure on to the molten material 20 to control the flow of the molten material 20 out of the container 30 on to the substrate 12. In this particular embodiment, pressure system 34 is a gas pressure system, although other types of pressure systems, such as a mechanical system can be used depending on the particular application. In another embodiment, a tundish can feed the molten material 20 into the container 30 from where it would be forced onto the substrate 12.

Figure 2:
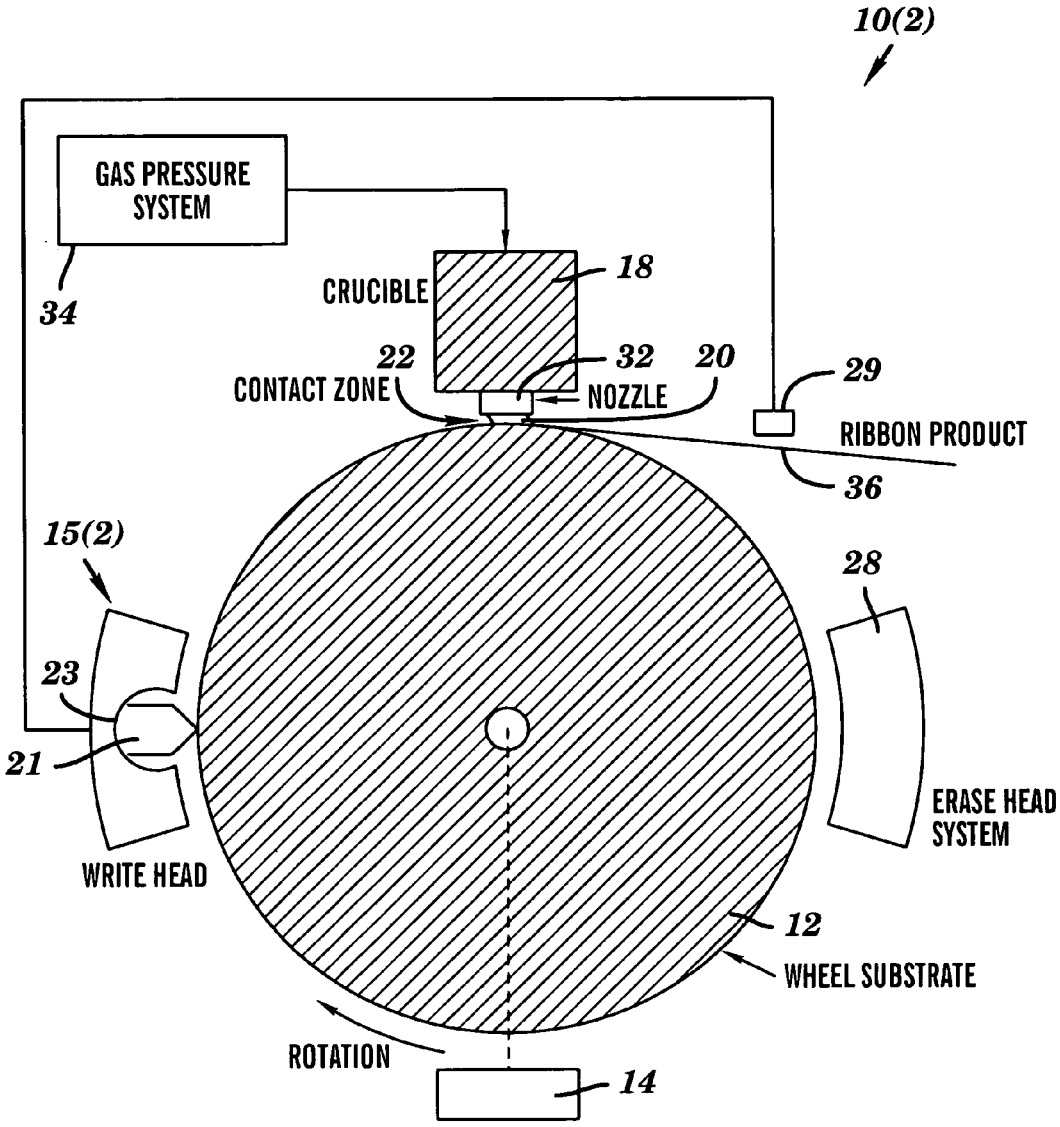
FIG. 2 is a side view of a system for casting a molten material in accordance with another embodiment of the present invention.

A system 10(2) for casting a molten material in accordance with another embodiment of the present invention is illustrated in FIG. 2. System 10(2) is identical to System 10(1) except as described below. Elements in FIG. 2 which are the same as those in FIG. 1 have numeral designations which correspond to those in FIG. 1 and will not be described in detail here.

In system 10(2), the writing system 15(2) is a compositional writing system comprising a nozzle 21 and a compositional distribution system 23, although other types of writing systems with other components, such as with multiple nozzles, can be used. An output end of the nozzle 21 is adjacent to and spaced from a portion of the substrate 12 before the contact region or zone 22. The compositional distribution system 23 includes a processor which executes programmed instructions stored in a memory to set the characteristics of the distribution of material on to the substrate 12 to generate a desired compositional gradient pattern, although compositional distribution system 23 can comprise other components and can operate in other manners. A sensor 29 is coupled by a feedback loop to the compositional distribution system 23. The sensor 29 provides information about the effect of the compositional gradient pattern on the resulting product 36 which the processor in system 23 uses to adjust the distribution of material on the substrate 12 by means of an appropriate control algorithm. In this embodiment, the nozzle 21 is under the control of the compositional distribution system 23 and distributes dots or other portions of material on a portion of the substrate 12, for example portions of liquid that dry quickly to form solid film. Adjusting the configuration and/or characteristics of the pattern affects the resulting product 36 being produced. A variety of different materials can be deposited on the substrate 12. In this particular embodiment, the compositional distribution system 23 manipulates the write nozzle 21 to traverse slowly in a crosswise direction across the width of the substrate 12 as material is being deposited, although the write nozzle 21 can be manipulated to move in other directions.

System 10(2) also includes an erasing system 28 that cleans or un-conditions the surface of the substrate 12. The type of erasing system 28 used depends on the writing system 15 used. Since in this particular embodiment, the writing system 15(2) lays down a pattern of dots of solid film on the substrate 12, the erasing system 28 is an abrasion system, although other types of erasing systems could be used. The erasing system 28 includes an emory or other abrasive cloth or material on a counter-rotating drum that removes the portions of film by being abrasive against the substrate 12, although erasing system 28 can comprise other types of components that operate in other manners. If, for example, the writing system removed thin solid film by laser ablation, then the erasing system 28 may comprise an abrasion system and a deposition system, although erasing system 28 could comprise other components that operate in other manners. The abrasion system would treat, i.e. abrade, at least a portion of the surface of the substrate 12 and then the deposition system would lay down a new continuous thin solid film on at least a portion of the surface of the substrate 12. If, in another example, the writing system is thermal writing system 15(1) as shown and describe herein with reference to FIG. 1, then an erasing system will generally not be needed since thermal conduction within the substrate 12 smoothes out the hot spots with time. For this to work, the substrate 12 is made of a material that is sufficiently conductive, such as Cu—Be, and there must be sufficient time (distance) between the nozzle 32 and the writing system 15(1) for the thermal gradient pattern to dissipate.

Accordingly, the writing system 15 is any mechanism by which the elements of a pattern can be imposed on the surface of the substrate 12—hot spots, materials spots or the absence of material spots are all examples—and which can be sufficiently controlled to form patterns that "appear" continuous on the scale of features relating to the quality of the product or form patterns on the molten material 20 as it is being deposited. The writing system 15 conditions the substrate 12 or molten material 20 with a pattern. The erasing system 28 is any mechanism by which the action of the write system 28 is eliminated, removed, or unconditioned.

A method for continuous casting of a molten material in accordance with one embodiment will now be described with reference to FIG. 1. The driving system 14 is engaged to begin to rotate the substrate 12. In this particular embodiment, the substrate 12 is rotated at a casting speed on the order of about ten m/s (linear velocity) to achieve solidification rates of the molten material on the order of about ten cm/s for aluminum, although the particular speed of rotation of the substrate 12 can vary as needed for the particular application.

Once the desired rotational speed for the substrate 12 is reached, the laser control system 17 controls the laser light signal or beam from the laser 16 to generate a thermal gradient pattern on a portion of the surface of the substrate 12. The goal is to generate a temperature disturbance which is enough to influence the solidification. In this particular example, the laser 16 outputs a laser light signal of wavelength about 1064 nm, although the characteristics of the light signal can vary based on the particular application. A laser-like device with signal in the visible, ultraviolet, infrared or any other part of the spectrum of electromagnetic radiation can be used depending on the application. The laser light signal induces a temperature disturbance whose amplitude depends on the volume of the substrate 12 heated. The volume heated is determined by the footprint of the spot and the depth of heating given by the thermal diffusion length. The heated depth can be taken to be constant because the pulse duration of the laser light signal is nearly constant with laser frequency for this embodiment. For example, for a duration of about 100 ns for the laser light signal, the depth is a few μm. Primarily, for a given substrate the footprint is determined by the optics built into the laser and the optics in the light path from the laser to its impingement on the substrate, in the embodiment in FIG. 4A this is the focusing lens 24 and the prism 26. The nature of the substrates and wavelength of light together determine how much light energy the substrate absorbs and how much it reflects. The temperature rise is inversely proportional to the square of the footprint length making it very sensitive to the optics used, i.e. the focusing lens and prism. For example, if 0.1 mJ of the energy is absorbed from a laser light signal or pulse, a footprint scale of 100 micron gives about a $10^3$ K temperature rise (near ablation) for a Cu—Be substrate while a one mm scale gives about a 10 K rise.

The thermal gradient pattern formed by the laser light signal is imposed on the substrate 12 before the contact region or zone 22 where the molten material 20 is deposited on the substrate 12. In this particular embodiment, the thermal gradient pattern has a plurality of thermal spots generated by the laser light signal heating the surface of the substrate 12 where the size of each spot is about ten microns and the spacing between spots is about 100 microns. Although one type of pattern is disclosed here, the type of thermal gradient pattern generated by the laser light signal will vary based upon the particular requirements of the product being produced. Some examples of other thermal gradient patterns which could be imposed on the substrate 12 are illustrated in FIGS. 5A-5D.

When generating a thermal gradient pattern, the rate of decay of the spots should be considered. Spots in the thermal gradient pattern generated by the laser light signal decay and spread on a thermal diffusion time. Heat will diffuse 100 microns in a substrate 12 made of copper-beryllium (Cu—Be) in about 100 μs during which time the substrate moves one mm (10 m/s motion and thermal diffusivity of order $10^{-4}$ $m^2/s$). As a result, in this particular embodiment spots in the thermal gradient pattern are created close to the nozzle 32, within one cm or closer in the embodiment shown in FIG. 4, to maintain spatial resolution until the contact zone 22. Additionally, in this particular embodiment in order to obtain spatial resolution of order 100 microns with a substrate 12 rotating at a speed of ten m/s, the laser 16 needs to be operated at a pulse rate of 100 kHz.

To generate two dimensional thermal gradient patterns, a technique to rapidly raster the laser light signal in a cross-stream direction is required. By way of example only, acousto-optical (AO) deflection of the laser light signal is possible using Bragg-cell technology at rates up to 100 kHz, although other techniques for creating two dimensional patterns could be used. In this particular example, AO scanners are utilized to deflect the incident laser light signal and control its location in the cross-stream direction. With a Bragg-cell driven by a frequency synthesizer and an amplifier, the incident laser light signal can be modulated at frequencies as high as 100 kHz. The Bragg-cell itself will be driven at much higher frequencies (80 MHz) and can produce deflection angles of order one degree with an accuracy of well within one in one hundred. By placing the Bragg-cell only a few centimeters from the substrate 12, the spatial location of the laser light signal on the substrate 12 can be controlled to the required accuracy.

Although in this particular embodiment, a thermal gradient pattern is generated on the substrate 12 to influence the solidification event, other types of patterns can be imposed on substrate 12. For example, a thin insulating film could be deposited on the substrate 12 and the laser light signal could be used to expose a compositional pattern in the film on the substrate 12 before the molten material is deposited. This is an example of negative templating. Patterns on the substrate 12 can also be imposed by chemical conditioning.

In another example, the embodiment shown in FIG. 2 operates the same as the one shown in FIG. 1 except for the operation of the writing system 15(2) and the erasing system 28. In this embodiment, the nozzle 21 deposits a pattern of dots or other portions of material on to at least a portion of the surface of the substrate 12 to form the gradient pattern. The conditioning of the substrate 12 with a gradient pattern, thermally or compositionally, can be applied and removed in substantially real time.

Referring back to the discussion of the operation of the system 10(1) shown in FIG. 1, in this particular embodiment as shown in FIG. 3 (which is not to scale), the pressure system 34 applies a gas pressure to the molten material 20 in the container 30 which causes the molten material 20 to be forced out through the nozzle 32. In this particular embodiment, micro-positioners on the overhead carriage (not shown) allow the nozzle 32 to be positioned precisely above the apex of the substrate 12, although the nozzle 32 can be oriented in different ways and at different locations depending on the application. In this particular embodiment, the dispensing end of the nozzle 32 is positioned so close to the substrate 12 that the nozzle interferes with the flow, although the particular position of the nozzle 32 can vary as needed for the particular application. Additionally, in this particular embodiment the molten material 20 is deposited at a rate of 10 $cm^2/s$ per unit width on to the substrate 12, although the particular rate can vary as needed for the particular application. The nozzle 32 dispenses the molten material 20 on to a portion of the substrate 12 to form a puddle of molten material 20 which solidifies or freezes to form the product 36. Typically, the puddle length L is one hundred times the ribbon thickness T and twenty times the gap G, although these dimension can vary as needed. In addition to the overpressure ΔP and the substrate velocity U, parameters which affect the dimensions of the resulting product 36 include the dimensions of gap G and of slot breadth B. Solidification takes place on contact with the substrate at a rate V that varies along the front. A ribbon of thickness T is spun or carried off from the substrate at a velocity U. The appropriate Reynolds number is based on mass throughput: $Re=\bar{u}G/v\sim2*10^3$ where $\bar{u}\equiv(T/G)U$. The stabilizing influence of suction (due to solidification) maintains a substantially laminar flow in the gap. By way of example only, if the molten material 20 is aluminum, it has a melting temperature of about $\theta_m$=660° C. The principal thermal control parameters are the temperature of the nozzle 32 which in this particular example is ($\theta_h$~720° C.), the temperature of the substrate 12 which in this particular example is ($\theta_c$~30° C.), and the contact heat-transfer coefficient H which in this particular example is about (~$10^5$ $W/cm^2$ K).

When the molten material 20 is dispensed on to the portion of the substrate 12 with the pattern, in this particular example a thermal gradient pattern, the pattern affects the solidification of the molten material 20 and thus the resulting end product 36. The pattern imposed on the substrate 12 permits a high quality ribbon product having a thickness less than about 1 mm to be produced at high rates.

In the operation of the embodiment shown in FIG. 1, an erasing system 28 is not needed because the thermal gradient pattern will dissipate before the next thermal gradient pattern is written on the surface of the substrate 12 as discussed earlier herein. In an another example for the operation of FIG. 1 where the writing system 15(1) uses the laser 16 for ablation, an erasing system may be used to remove any remaining pattern and to add a thin film of material onto the surface of the substrate 12. The erasing system removes the prior gradient pattern and prepares the surface for subsequent ablation. By way of example only, such an erasing system may spray a film, such as BN, on the substrate 12 to erase a prior pattern. The laser 16 will then write a new pattern on to a portion of the film on the substrate 12.

In the operation of the system 10(2) shown in FIG. 2, an erasing system 28 is positioned after the contact zone 22 to remove the compositional gradient pattern formed on the surface of substrate 12. The erasing system 28 brings the substrate 12 back to an unconditioned state by removing the pattern, such as by abrading the pattern from the surface of the substrate as described earlier. The surface of the substrate 12 is then ready for the application of the next compositional gradient pattern.

Accordingly, the present invention provides a system and method for continuous casting of molten metals, in substantially a single step, to the specifications of the designer and also for coating a product with a molten material. The system and method reduce the number of processing steps required to produce a thin ribbon product from a molten material and the number of steps needed to coat a product with a molten material. Reducing the number of processing steps provides a number of benefits, including reducing capital costs, manufacturing costs, and saving energy.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A method for controlling and manipulating solidification of a molten material, the method comprising:

generating a gradient pattern comprising multiple elements on at least one of at least a portion of a substrate and at least a portion of the molten material, wherein the gradient pattern is in a matrix format; and depositing the molten material on at least a portion of the substrate at least partially at the location of the gradient pattern on the at least one of the substrate and the molten material.

2. The method as set forth in claim 1 further comprising substantially erasing the gradient pattern imposed on the substrate after the depositing.

3. The method as set forth in claim 1 wherein the gradient pattern is a thermal gradient pattern.

4. The system as set forth in claim 1 wherein the gradient pattern is a compositional gradient pattern.

5. The method as set forth in claim 1 wherein the generating comprises directing a light signal from a laser on the substrate to impose the gradient pattern.

6. The method as set forth in claim 5 wherein the generating further comprises reflecting the laser light signal onto the substrate.

7. The method as set forth in claim 1 further comprising rotating the substrate.

8. The method as set forth in claim 7 wherein the substrate is a wheel.

9. The method as set forth in claim 7 wherein the substrate is a belt.

10. The method as set forth in claim 7 wherein the substrate is a product that is being coated with the molten material.

11. The method according to claim 1 wherein the depositing further comprises applying pressure to the molten material being dispensed.

12. A method for controlling and manipulating solidification of a molten material, the method comprising:

generating a gradient pattern on at least a portion of a substrate;

depositing the molten material on at least a portion of the substrate with the gradient pattern;

obtaining information about an effect of a gradient pattern on a resulting product from the deposited molten material; and controlling the generating of the gradient pattern based on the obtained information.

13. A method for controlling and manipulating solidification of a molten material, the method comprising:

generating a gradient pattern on at least a portion of a substrate;

depositing the molten material on at least a portion of the substrate with the gradient pattern;

wherein the gradient pattern is a compositional gradient pattern and wherein the compositional gradient pattern comprises at least one material deposited on the substrate.

14. A method for continuous casting of a molten material, the method comprising:

rotating a substrate;

generating a gradient pattern comprising multiple elements on at least one of at least a portion of the substrate and at least a portion of the molten material, wherein the gradient pattern is in a matrix format; and depositing the molten material on at least a portion of the substrate at least partially at the location of the gradient pattern on the at least one of the substrate and the molten material.

15. The method as set forth in claim 14 further comprising substantially erasing the gradient pattern imposed on the substrate after the depositing.

16. The system as set forth in claim 14 wherein the gradient pattern is a thermal gradient pattern.

17. The system as set forth in claim 14 wherein the gradient pattern is a compositional gradient pattern.

18. The method as set forth in claim 14 wherein the generating comprises directing a light signal from a laser on the substrate to impose the gradient pattern.

19. The method as set forth in claim 18 wherein the generating further comprises reflecting the laser light signal onto the substrate.

20. The method as set forth in claim 18 wherein the substrate is a wheel.

21. The method as set forth in claim 18 wherein the substrate is a belt.

22. The method according to claim 18 wherein the depositing further comprises applying pressure to the molten material being dispensed.

23. A method for continuous casting of a molten material, the method comprising:

rotating a substrate;

generating a gradient pattern on at least one of at least a portion of the substrate;

depositing the molten material on at least a portion of the substrate with the gradient pattern;

obtaining information about an effect of a gradient pattern on a resulting product from the deposited molten material; and controlling the generating of the gradient pattern based on the obtained information.

24. A method for continuous casting of a molten material, the method comprising:

rotating a substrate;

generating a gradient pattern on at least one of at least a portion of the substrate;

depositing the molten material on at least a portion of the substrate with the gradient pattern;

wherein the gradient pattern is a compositional gradient pattern and wherein the compositional gradient pattern comprises at least one material deposited on the substrate.

* * * * *

UNITED STATES PATENT AND TRADEMARK OFFICE

CERTIFICATE OF CORRECTION

PATENT NO. : 7,306,025 B2
APPLICATION NO. : 11/395673
DATED : December 11, 2007
INVENTOR(S) : Paul H. Steen It is certified that error appears in the above-identified patent and that said Letters Patent is hereby corrected as shown below:

Column 8, line 54, replace, “system” with --method--;
Column 9, line 42, replace, “system” with --method--; and
Column 10, line 1, replace, “system” with --method--.

Signed and Sealed this

Third Day of June, 2008

JON W. DUDAS
*Director of the United States Patent and Trademark Office*